US006079820A

United States Patent [19]

Dijksman et al.

[11] Patent Number: 6,079,820

[45] Date of Patent: Jun. 27, 2000

[54] INK JET PRINTHEAD AND INK JET PRINTER

[75] Inventors: Johan F. Dijksman; Adrianus C. Van Kasteren, both of Eindhoven; Johannes van Zwol, Roermond, all of Netherlands; Martin Fleuster, Aachen, Germany; Johannes A. De Wit; Ramin Badie, both of Eindhoven, Netherlands; Marcel J. J. Damen, Sittard, Netherlands; Andreas C. M. Van Nes; Joseph R. R. Pankert, both of Eindhoven, Netherlands

[73] Assignee: U.S. Philips Corporation, New York, N.Y.

[21] Appl. No.: 08/956,882

[22] Filed: Oct. 23, 1997

[30] Foreign Application Priority Data

Oct. 30, 1996 [EP] European Pat. Off. ..... 96203032
May 29, 1997 [EP] European Pat. Off. ..... 97201584

[51] Int. Cl.[7] ..... B41J 2/045

[52] U.S. Cl. ..... 347/68; 347/70

[58] Field of Search ..... 347/68–71, 54

[56] References Cited

U.S. PATENT DOCUMENTS 4,599,628 7/1986 Doring et al. ..... 346/140
5,684,520 11/1997 Morikoshi et al. ..... 347/70
5,710,584 1/1998 Suzuki et al. ..... 347/70
5,793,394 8/1998 Kato ..... 347/70
5,818,482 10/1998 Ohta et al. ..... 347/70
5,850,240 12/1998 Kubatzki et al. ..... 347/71

FOREIGN PATENT DOCUMENTS

0573055A2 8/1993 European Pat. Off. .

*Primary Examiner*—John Barlow
*Assistant Examiner*—J. Stephens
*Attorney, Agent, or Firm*—F. Brice Faller

[57] ABSTRACT

A printhead which comprises a body with pressure chambers (13) and nozzles (14), a membrane (17) connected to the body so as to form one wall of the pressure chambers, and an actuator plate (25) comprising an actuator element (31) for each pressure chamber. A support plate (19) between the actuator plate and the membrane includes first portions (21) and second portions (23) with the first portions being movable relative to the second portions in the direction of the thickness of the support plate, a first portion being situated between each actuator element and the corresponding pressure chamber. The actuator plate has active regions (31) and inactive regions (33), the actuator elements being formed by active regions of the actuator plate. Adjacent actuator elements are separated from each other over substantially their whole length by slits (35) in the actuator plate. The actuator plate can be a ceramic multilayer actuator (CMA).

27 Claims, 9 Drawing Sheets

INK JET PRINTHEAD AND INK JET PRINTER

BACKGROUND OF INVENTION

1. Field of the Invention

The invention relates to an ink jet printhead comprising: a body having first and second opposite main faces, a plurality of pressure chambers and a corresponding plurality of nozzles being provided in the body, each pressure chamber extending between the first main face of the body and one of the nozzles and each nozzle extending between one of the pressure chambers and the second main face of the body; a membrane having first and second main faces, said membrane being connected to the body with its second main face facing the first main face of the body;

an actuator plate having first and second main faces, the second main face of said actuator plate facing the first main face of the membrane, said actuator plate comprising a plurality of actuator elements corresponding to the plurality of pressure chambers, the positions of the actuator elements in the actuator plate corresponding to the positions of the pressure chambers in the body, each actuator element being conceived to change its dimension in the direction of the thickness of the actuator plate upon application of a suitable voltage to the actuator element. The invention also relates to an ink jet printer comprising an ink jet printhead of this type.

2. Description of the Related Art

An ink jet printhead of the type set forth is known from U.S. Pat. No. 4,599 628. In the known printhead, the actuator plate is a piezoceramic plate. The actuator elements are embossed parts of the actuator plate that overly the pressure chambers. The actuator elements are provided with film electrodes to which electrical connections have to be made outside the area above the pressure chambers so that the mass of the electrical connections does not affect the resonance frequency of the actuator elements. Consequently, the area of the actuator elements necessarily exceeds the area of the pressure chambers so that the total area of the actuator plate is comparatively large. Moreover, many electrical connections have to be made with great precision which is time-consuming and increases the manufacturing cost of the device.

SUMMARY OF THE INVENTION

It is an object of the invention to provide an ink jet printhead of the kind set forth, in which the actuator elements may have the same or even a smaller area than the pressure chambers and in which electrical connections to the actuator elements can be made easily and at some distance from the pressure chambers, the efficiency with which energy is transferred from the actuator elements to the liquid in the pressure chambers being at least as high as in the known device. To achieve this object the printhead in accordance with the invention is characterized in that between the second main face of the actuator plate and the first main face of the membrane there is provided a support plate comprising first portions and a second portion, said first portions being movable relative to the second portions in the direction of the thickness of the support plate, a first portion being situated between each actuator element and the corresponding pressure chamber;

the actuator plate having active regions and inactive regions, the actuator elements being formed by active regions of the actuator plate, adjacent actuator elements being separated from each other over substantially their whole length by slits provided in the actuator plate.

The first portions of the support plate act as pistons that are driven by the actuator elements. The surface area of these pistons may be only slightly smaller than that of the pressure chambers so that sufficient play exists between each piston and the walls of the corresponding pressure chamber to ensure that the piston can move freely. The corresponding actuator element may have a smaller area than the piston without the efficiency of the energy transfer being adversely affected.

In a particular embodiment of the invention, the actuator plate is a ceramic multilayer actuator (CMA). The use of CMAs in ink jet printheads is known per se, e.g. from EP-A-0 573 055. Some advantages of such devices are that their efficiency is high and that the contacts can be made at an area remote from the active regions. In the known ink jet printhead the actuator elements are formed as bars that change their length upon application of a suitable voltage. As a result, the thickness of the printhead (the dimension in a direction perpendicular to the main faces of the body) is rather large, which is in conflict with the desire to reduce the dimensions of the printhead.

A preferred embodiment of the printhead in accordance with the invention is characterized in that a top plate is attached to the first main face of the actuator plate, the top plate being provided with slits corresponding to the slits in the actuator plate. As set forth above, the actuator elements are conceived to change their dimension in the thickness direction. When an ink droplet is to be emitted, the relevant actuator element is controlled such that its thickness increases. This results in a displacement towards the pressure chamber of the second main face of the actuator element and a displacement away from the pressure chamber of the first main face of the actuator element. The top plate serves to restrain the motion of the first main face (by introducing an extra shear stiffness), thereby enhancing the motion of the second main face and, consequently, the efficiency of the process of droplet emission.

A further preferred embodiment is characterized in that the top plate comprises first portions substantially extending over the active regions of the actuator plate and second portions substantially extending over the inactive regions of the actuator plate, the first portions of the top plate having a smaller thickness than the second portions. When the actuator element is controlled so that its thickness increases, its length will automatically tend to decrease. The thin portion of the top plate opposes this shortening in length of the actuator element causing the actuator element to bend in the direction of the pressure chamber. This effect increases the volume displacement and, consequently, the efficiency of the droplet emission.

BRIEF DESCRIPTION OF THE DRAWINGS

The invention and its attendant advantages will now be elucidated in further detail with the aid of exemplary Embodiments and the accompanying schematic drawings, in which.

DETAILED DESCRIPTION OF THE PREFERRED EMBODIMENTS

Embodiment 1

Figure 1:
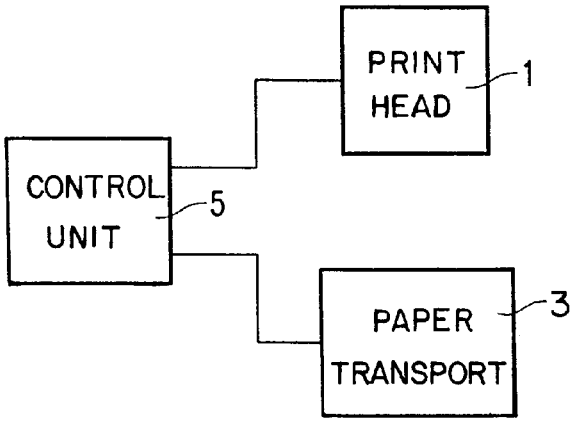
FIG. 1 is a simplified block diagram of an ink jet printer.

FIG. 1 is a block diagram showing only the most essential parts of an ink jet printer in accordance with the invention. Such a device comprises a printhead 1, a paper transport mechanism 3 and a control unit 5. The general construction of ink jet printers is well known in the art. The printer according to the invention differs from the known devices mainly in the construction of the printhead 1.

Figure 2:
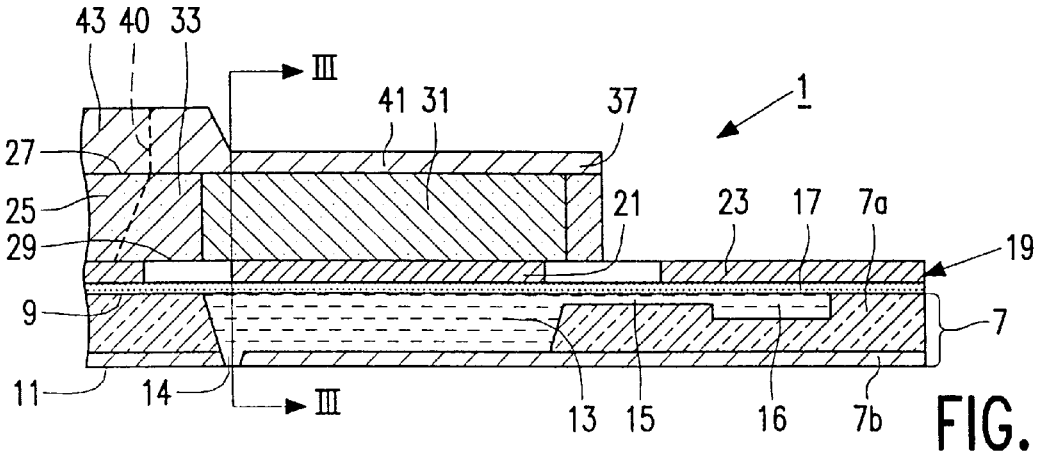
FIG. 2 is a section in the longitudinal direction of an actuator element of an embodiment of an ink jet printhead in accordance with the invention.
Figure 3:
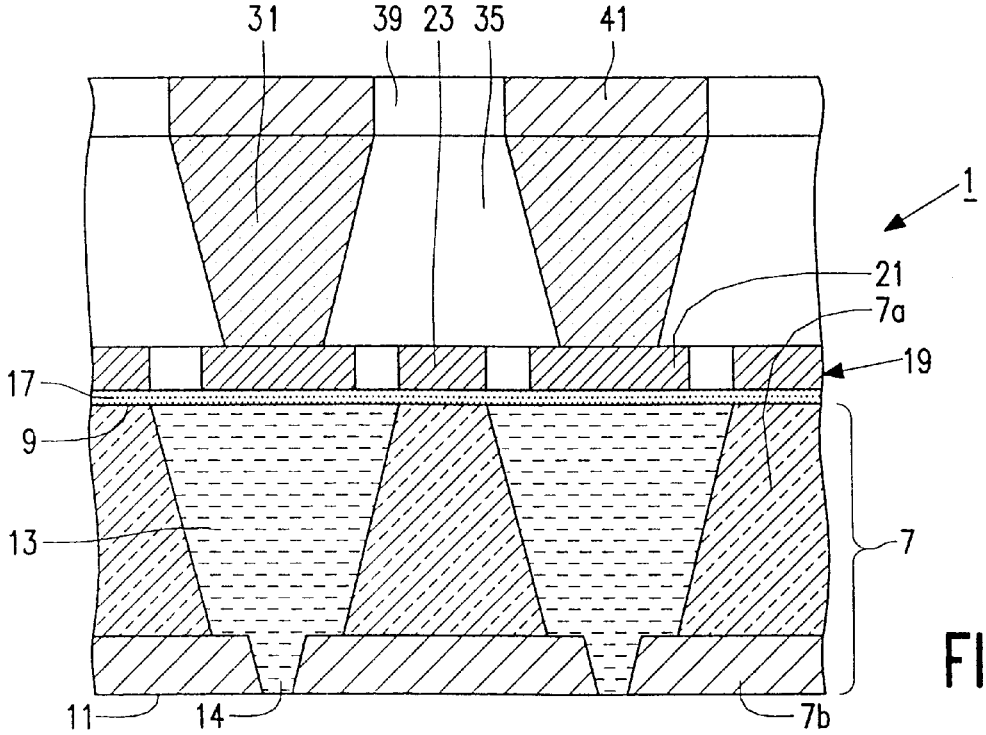
FIG. 3 is a cross-section on an enlarged scale of a part of the ink jet printhead shown in FIG. 2.
Figure 4:
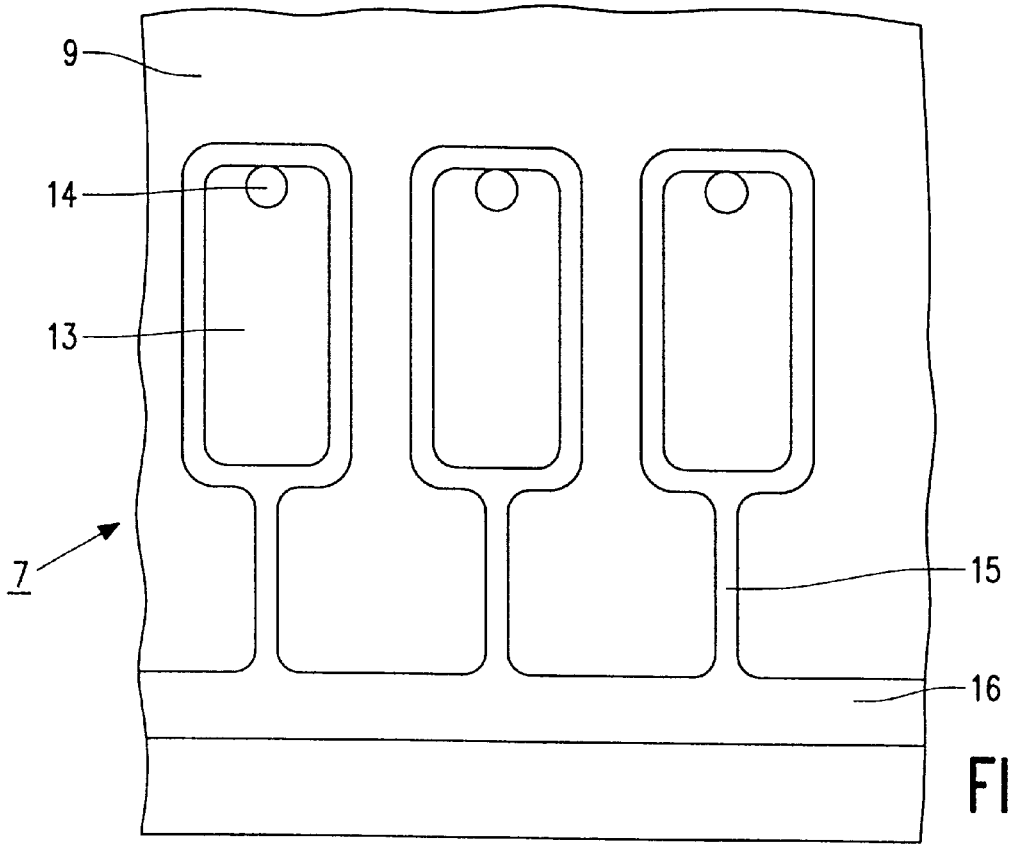
FIG. 4 is a top view of a part of a body of the printhead shown in FIGS. 2.
Figure 5:
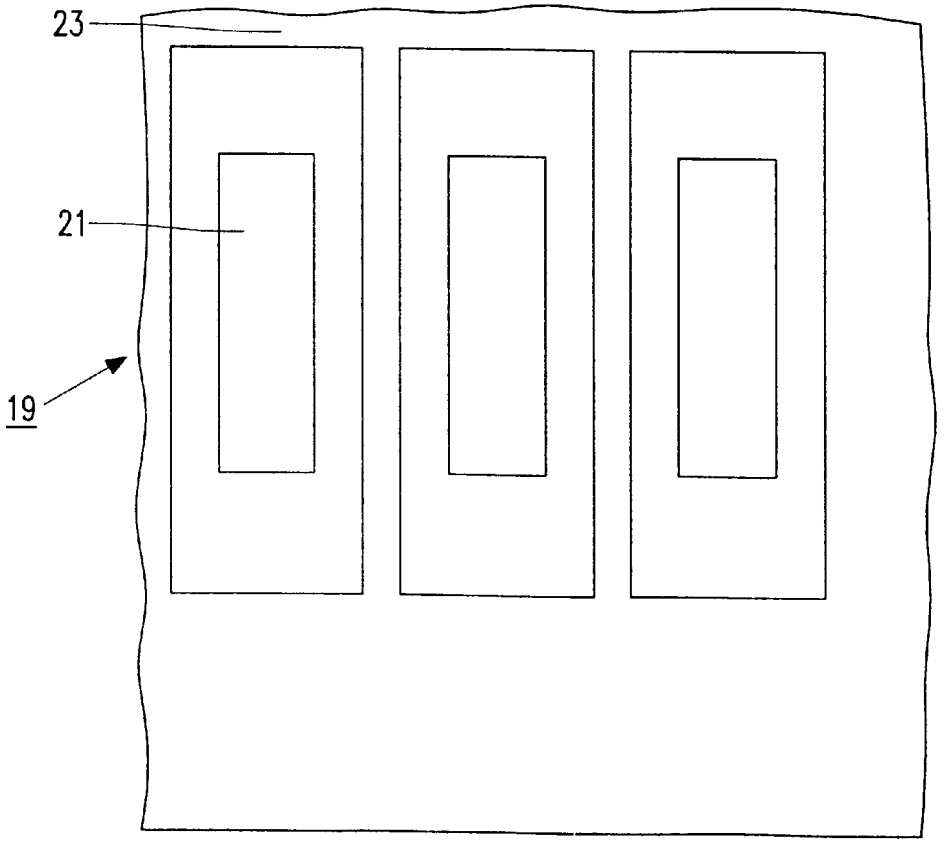
FIG. 5 is a t op view of a part of a support plate of the printhead.
Figure 6:
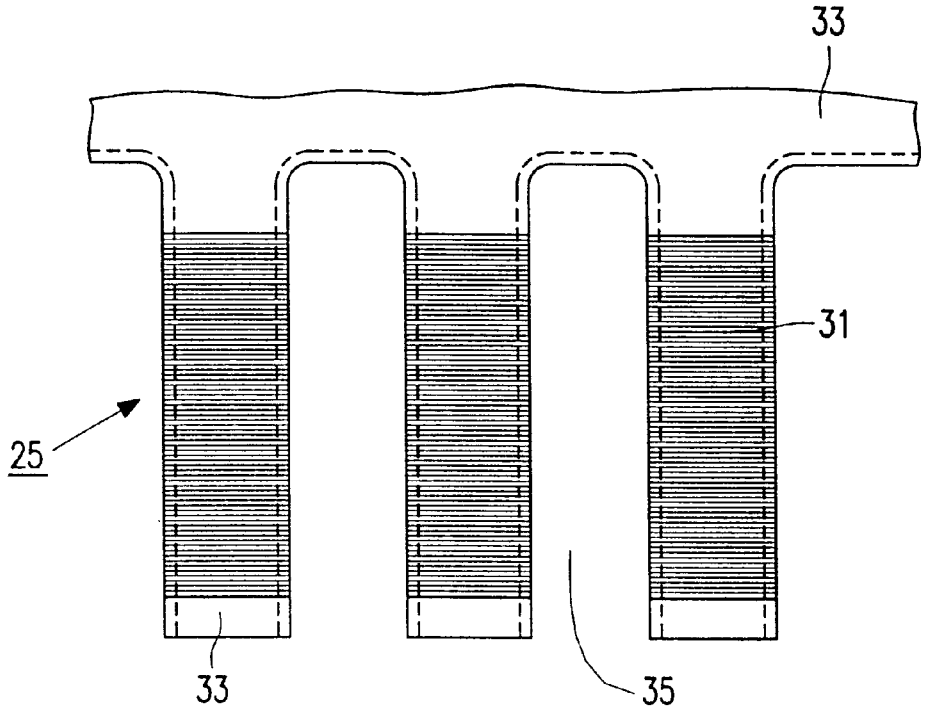
FIG. 6 is a top view of a part of an actuator plate of the printhead.
Figure 7:
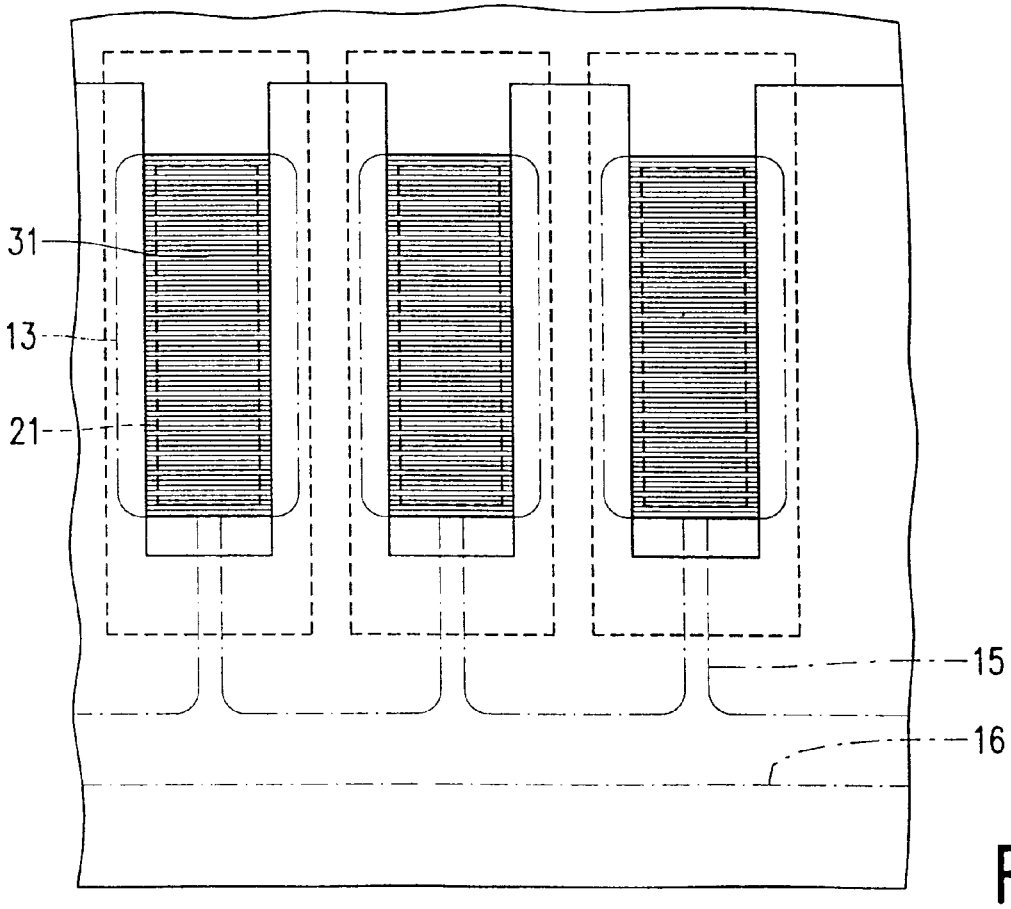
FIG. 7 is a top view of the printhead comprising an assembly of the elements shown in FIGS. 4, 5 and 6.

FIGS. 2, 3 and 7 show different views of an embodiment of the printhead 1 in accordance with the invention and FIGS. 4, 5 and 6 show some parts of the printhead. The printhead 1 comprises a plate-shaped body 7 which may be made of a single plate of a suitable material, for example glass. In the embodiment shown the body comprises a stack of a first plate 7*a* and a second plate 7*b* which may be made of the same material or of different materials (e.g. glass for the first plate and a metal such as nickel for the second plate). The body 7 has a first main face 9 and a second, oppositely situated main face 11. In FIGS. 2 and 3 the body 7 extends horizontally with the first main face 9 above the second main face 11. In FIG. 4 the first main face 9 is visible. A plurality of pressure chambers 13 and a corresponding plurality of nozzles 14 are provided in the body 7, e.g. by etching, powder blasting or another suitable method. Each pressure chamber 13 extends between the first main face 9 and one of the nozzles 14 and each nozzle extends between one of the pressure chambers and the second main face 11. In the embodiment shown, the pressure chambers 13 are provided in the first plate 7*a* (the chamber plate) and the nozzles 14 are provided in the second plate 7*b* (the nozzle plate). The pressure chambers 13 preferably have an elongated shape with a length of e.g. 2 mm and a trapezoidal cross-section (top e.g. 300 $\mu$m wide and bottom e.g. 150 $\mu$m wide). Their depth (which is equal to the thickness of the chamber plate 7*a*) may be e.g. 400 $\mu$m. Each pressure chamber 13 is connected by a narrow ink supply channel 15 to an ink supply duct 16 which may be provided in the body 7 by the same method as the pressure chambers 13. The first main face 9 of the body 7 is covered with a thin membrane 17 of a suitable material, e.g. a polyamide foil. The membrane 17 also forms a top wall of the pressure chambers 13, the bottom wall of the pressure chambers being formed by the nozzle plate 7*b*. The membrane 17 has first and second main faces, the second main face facing the first main face 9 of the body 7.

Figure 8:
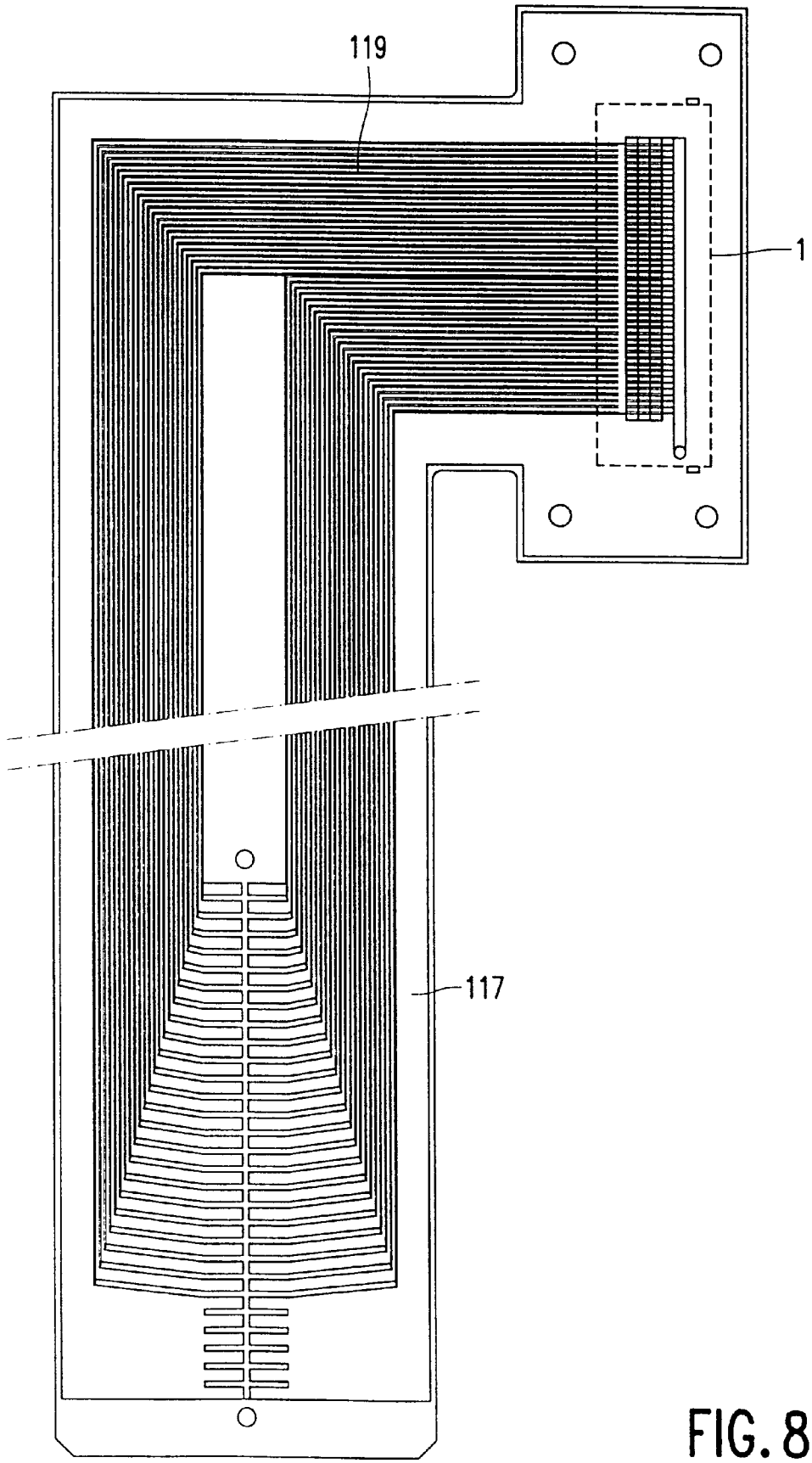
FIG. 8 is a top view of an assembly comprising the printhead and a flex foil for making electrical connections to the printhead.

On the first main face of the membrane plate 17 (which faces away from the body 7) there is provided a support plate 19 which is shown in top view in FIG. 5. The support plate 19 comprises first portions 21 and a second portion 23. The first portions 21 are movable relative to the second portion 23 in the direction of the thickness of the support plate 19, that is the vertical direction in FIGS. 2 and 3. In the embodiment shown, the second portion is a frame that is attached to the membrane 17 at those places of the membrane that overly the portions of the body 7 which extend between the pressure chambers 13. The first portions 21 are rectangular plates that are attached to those portions of the membrane 17 that overly the pressure chambers. The support plate 19 may be made of a suitable metal such as nickel or copper. It may be manufactured by first attaching a metal plate or foil to the membrane 17 and then removing the parts of the metal between the first and second portions 21, 23, e.g. by etching. As shown in FIG. 8, the combination of the polyamide foil and the metal may extend outside the printhead 1, forming a flex foil 117 with metal conductor tracks 119 which can be used for electrically connecting the printhead to the control unit 5, for example. It is also possible to form the support plate 19 as a separate structure by etching or machining a nickel plate such that narrow bridges of nickel remain between the first and second portions 21, 23, the bridges allowing movement of the first portions relative to the second portion. This structure can then be attached to the membrane 17.

On top of the support plate 19 there is provided a substantially planar actuator plate 25 having a first main face 27 and a second main face 29 which are parallel to the plane of the actuator plate. The second main face 29 is connected to the support plate 19 so that it faces the membrane 17. The actuator plate 25, a top view of which is shown in FIG. 6, is a ceramic multilayer actuator (CMA) comprising a plurality of layers of a piezoelectric material alternated with metal electrode layers. This layer structure is not shown in FIGS. 2 and 3 in order not to overload these Figures with details. A more detailed description of this structure can be found e.g. in WO 96/14 988. The actuator plate 25 comprises active regions 31 and inactive regions 33. The active regions 31 act as actuator elements that change their dimension in the direction of the thickness of the actuator plate 25 (perpendicular to main faces 27 and 29) upon application of a suitable voltage to terminals (not shown) that are electrically connected to the electrode layers in the actuator element and to the conductor tracks 119 (FIG. 8). As can be seen clearly in FIGS. 6 and 7, the actuator elements 31 have an elongated shape, their longitudinal direction extending parallel to the longitudinal direction of the pressure chambers 13. The position of each actuator element 31 is directly over a respective one of the pressure chambers 13. Adjacent actuator elements 31 are separated from each other by slits 35 provided in the actuator plate 25. The slits 35 end in the inactive regions 33 so that the adjacent actuator elements 31 are mechanically decoupled over their whole length.

The length and the width of each actuator element 31 are substantially equal to or slightly smaller than the corresponding dimensions of the corresponding pressure chamber 13. A first portion 21 of the support plate 19 is situated between each actuator element 31 and the corresponding pressure chamber 13. The length and width of the first portions 21 are slightly less than the corresponding dimensions of the pressure chambers 13 so that the first portions can move into the pressure chambers. When a suitable voltage is applied to one of the actuator elements 31, the actuator element increases its thickness so that its upper surface in FIGS. 2 and 3 moves upward and its lower surface moves downward. The movement of the lower surface forces the first portion 21 of the support plate 19 into the pressure chamber 13 so that the volume of the pressure chamber is decreased which causes a droplet of ink to be emitted via the nozzle 14. The first portion 21 thus acts as a piston that is driven into the pressure chamber 13 (acting as a cylinder) by the force exerted by the actuator element 31. When the voltage is removed or reversed, the volume of the pressure chamber 13 increases again, causing ink to flow (driven by the capillary pressure in the nozzle 14) from the ink supply duct 16 to the pressure chamber via the ink supply channel 15. The second portion 23 of the support plate 19 serves to provide a leak-free connection between the membrane 17 and the body 7.

In order to enhance the efficiency of the described process of droplet emission, a top plate 37, for example, an iron-nickel plate is preferably attached to the first main face 27 of the actuator plate 25. The shape of the top plate 37 as seen from above is substantially the same as the outline of the actuator plate shown in FIG. 6. Consequently, the top plate 37 has slits 39 (shown in FIG. 3) that substantially coincide with the slits 35 of the actuator plate 25 so that the top plate does not undo the mechanical decoupling of the actuator elements 31. In FIG. 2 the end of the slits 35, 39 is indicated by means of a dotted line 40. The top plate 37 comprises first portions 41 that substantially extend over the active regions 31 of the actuator plate 25 and second portions 43 that substantially extend over the inactive regions 33. The top plate 37 as a whole serves to impart an extra shear stiffness to the actuator plate 25 so that the displacement upwards of its first face 27 is restrained. As a consequence the expansion of an actuator element 31 upon application of a voltage causes an increased displacement downwards of the corresponding first portion 21 of the support plate 19, thus enhancing the efficiency of the actuator element.

The increase in thickness of the actuator element 31 upon application of a suitable voltage is accompanied by a shortening of the element in its longitudinal direction. The first portion 41 of the top plate 37, which overlies the actuator element, opposes this shortening causing the actuator element 31 to bend downwards. This effect further increases the efficiency. The effect is increased if the first portions 41 have a smaller thickness than the second portions 43. The first portions 41 then mainly serve to cause the bending, the second portions 43 mainly serving to oppose the displacement upwards of the first face 27 of the actuator plate 25.

Embodiment 2

FIGS. 9–13 render different views of various aspects of a particular embodiment of an ink jet printhead 201 according to the invention. Corresponding features in the various Figures are denoted by the same reference numerals, which differ from the corresponding reference numerals in FIGS. 1–8 only in that they are here preceded by a "2".

Figure 9:
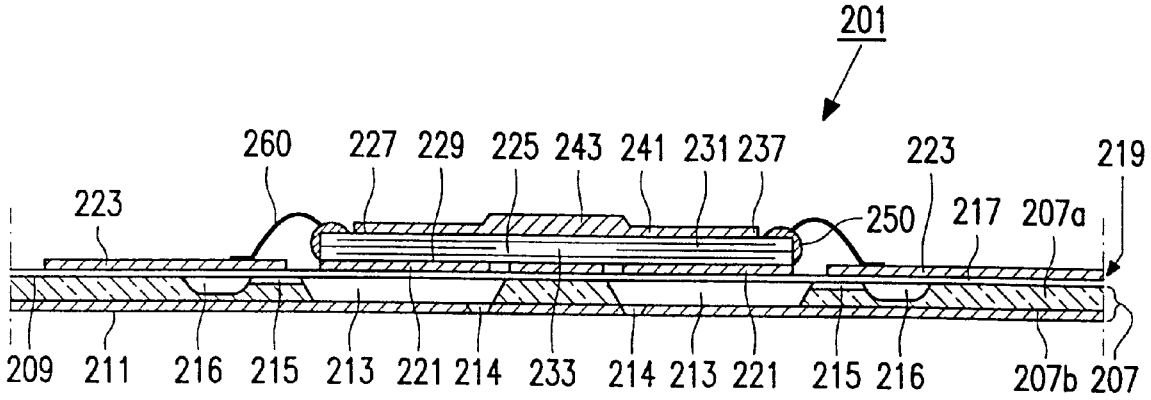
FIG. 9 is a section in the longitudinal direction of another embodiment of an ink jet printhead in accordance with the invention (more particularly, a four-color printhead)
Figure 10:
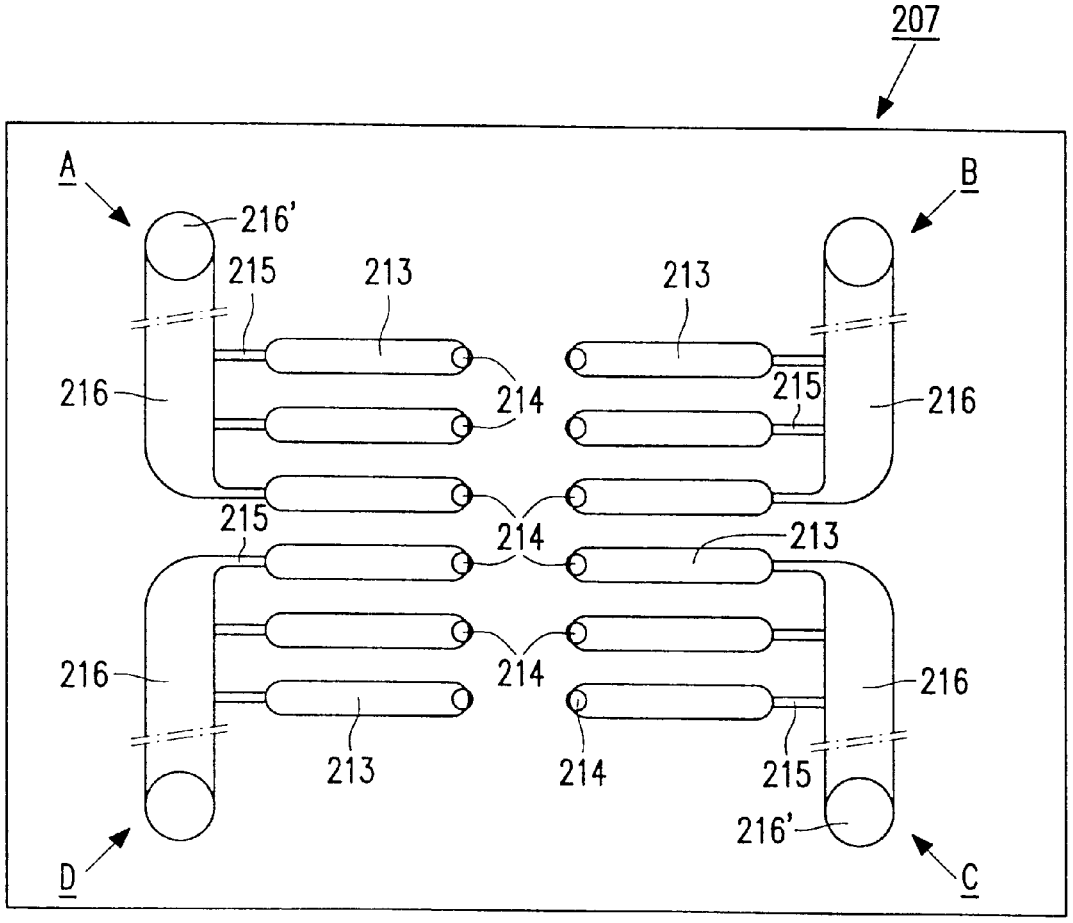
FIG. 10 renders a plan view of part of the subject of FIG. 9 (more specifically, various aspects of the ink supply vessels in the plate-shaped substrate body)

FIG. 9 shows a longitudinal section of part of a four-color ink jet printhead 201, and FIG. 10 gives a plan view of the plate-shaped substrate body 207 of the same head 201. As is evident from FIG. 10, the pressure chambers 213, nozzles 214 and ink supply channels 215 are in fact arranged in a plurality of pairs which extend into the plane of FIG. 9. Each chamber 213 is connected via the adjacent channel 215 to an ink supply duct 216, of which there are four (see FIG. 10). The chambers 213 and nozzles 214 are arranged in 4 clusters A,B,C,D (FIG. 10), corresponding respectively to colors a,b,c and d (e.g. black, cyan, magenta and yellow, respectively). The number of nozzles 214 in each of the clusters A,B,C,D is, for example, 48.

The actuator plate 225 is a CMA. As depicted in FIG. 9, electrical contacting of the sides of the actuator plate 225 is here achieved using a blob 250 of conductive metal (e.g. solder or gold) to which at least one wire bond 260 is attached, the other end of each wire bond 260 making contact with a second portion 223 of the support plate 219. However, there are alternative contacting methods, as will be further elucidated in following Embodiments.

Figure 11:
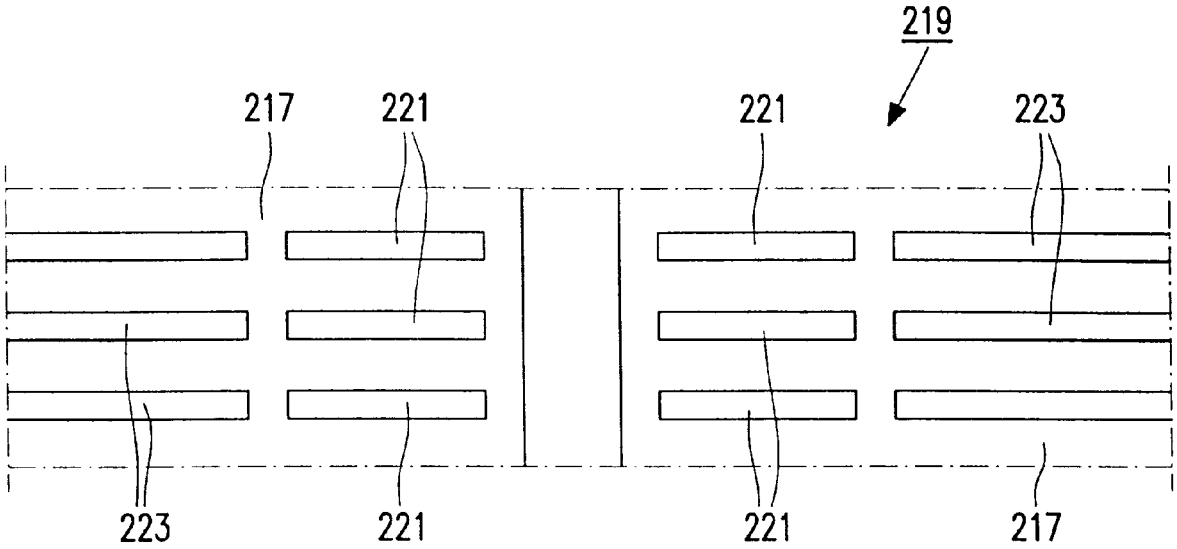
FIG. 11 gives a plan view of another part of the subject of FIG. 9 (more specifically, the support plate)

FIG. 11 renders a plan view of part of the support plate 219 in FIG. 9. The first portions 221 are positioned in such a way as to overlap with the chambers 213 (FIG. 10) when the support plate 219 is superimposed upon the plate-shaped body 207 (FIG. 9), there being one first portion 221 for each chamber 213. The first portions 221 serve as pistons, whereas the second portions 223 serve as electrical leads. The membrane 217 may be embodied as a KAPTON foil, for example.

Figure 12:
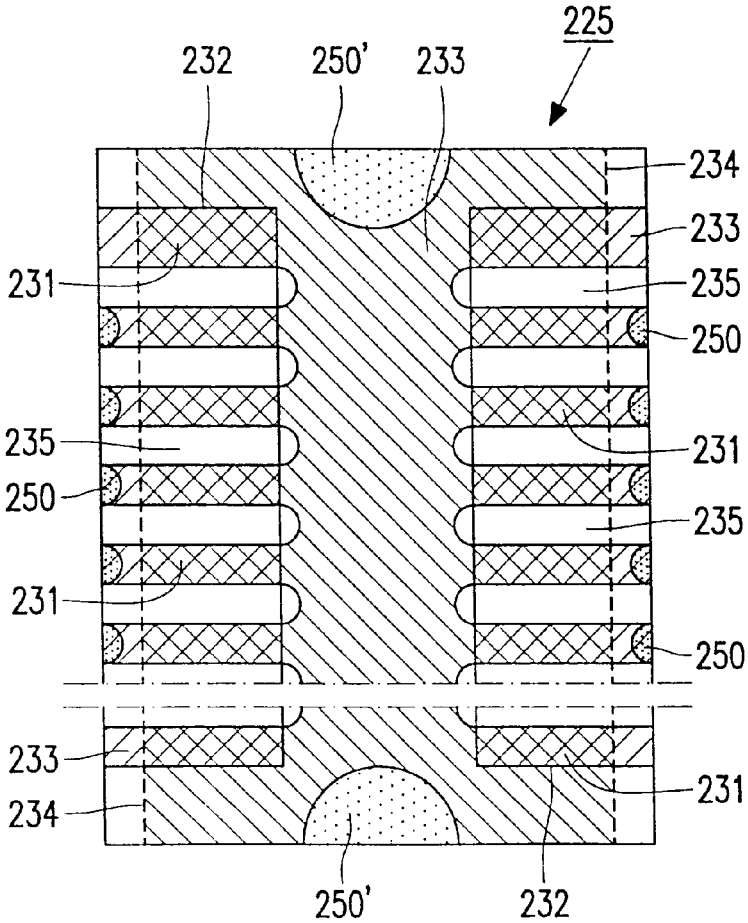
FIG. 12 shows a plan view of yet another part of the subject of FIG. 9 (more specifically, the actuator plate)

FIG. 12 shows a plan view of the actuator plate 225, which comprises active regions 231 and inactive regions 233. Depicted are addressable electrode layers 232 and a common electrode layer 234, the active regions 231 occurring where the former and the latter overlap; since the actuator plate 225 is a CMA, several such common and addressable electrode layers 232,234 will be interleaved in alternate arrangement (being mutually separated by ceramic material). The active regions (actuator elements) 231 are embodied as finger-like protrusions which extend along the long sides of the plate 225 in alternate arrangement with intervening slits 235. The actuator elements 231 are positioned in such a way as to overlap with the pistons 221 (FIG. 11) when the actuator plate 225 is superimposed upon the support plate 219 (FIG. 9, 11), there being one piston 221 for each actuator element 231. Also shown are wire-bond pads (metallic blobs) 250 at the free extremities of the actuator elements 231, allowing electrical connection of each element 231 to the respective electrical lead 223 via a wire bond 260 (not depicted); additional (larger) wire-bond pads 250' are provided at the butt-ends of the plate 225, and serve to make a common zero electrical connection to the common electrode layer 234.

Figure 13:
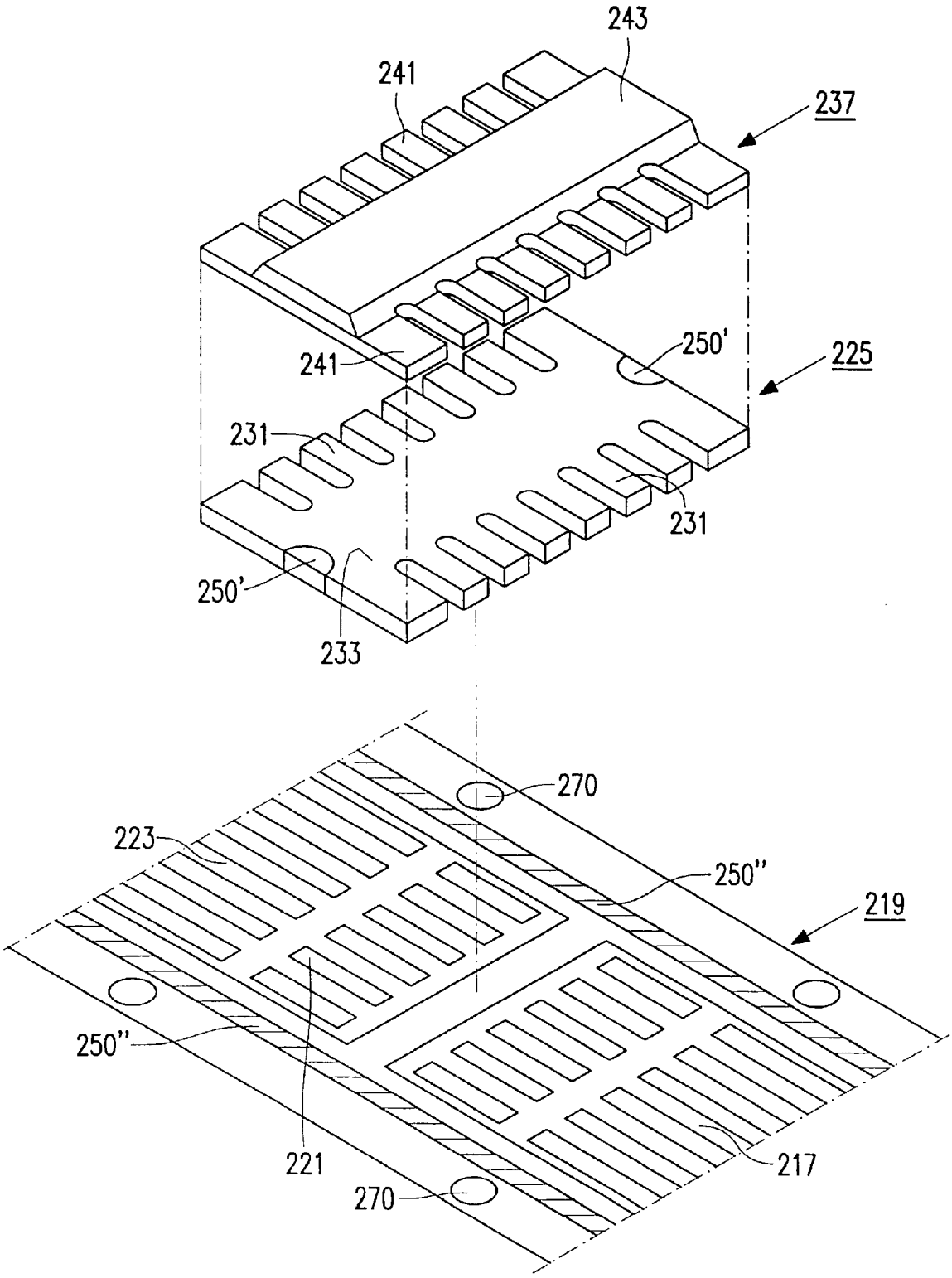
FIG. 13 is an exploded perspective view of the mutual interrelationship between various parts of the subject of FIG. 9.

FIG. 13 is an exploded perspective view of the mutual interrelationship between various parts of the subject of FIG. 9. It shows the actuator plate 225 of FIG. 12 which is overlaid by the top plate 237. The top plate 237 comprise first portions 241 and a second portion 243, the former taking the form of fingers which overlap with the actuator elements 231 of the actuator plate 225 and the latter (243) being embodied as a single (thicker) region which covers the central inactive region 233 of the actuator plate 225. The ensemble 237,235 is placed atop the support plate 219 in such a manner that the actuator elements 231 overlie the pistons 221 (but not the electrical leads 223). The membrane 217 is provided with two metallic ground lines 250' to which the wire-bond pads 250' of the actuator plate 225 can be electrically connected.

Also depicted in the membrane 217 are four ink feed-through holes 270, which are arranged so as to overlie the four ink inputs 216' of the supply ducts 216 in FIG. 10. When the ensemble 237,225,219 is positioned atop the substrate body 207 of FIG. 10, the pistons 221 (FIG. 13) overlie the chambers 213.

Embodiment 3

Figure 14:
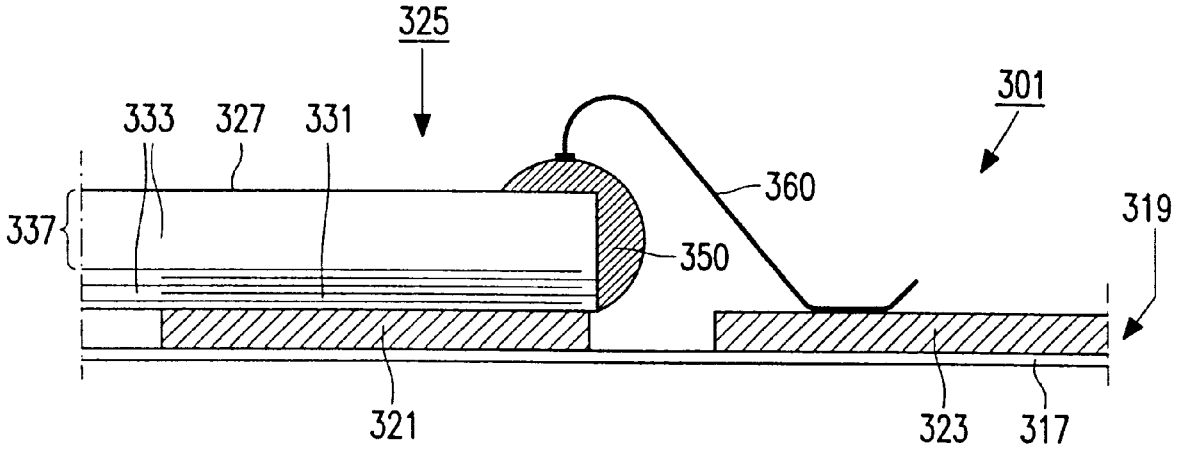
FIG. 14 is a partial longitudinal section of an alternative embodiment of an ink jet printhead according to the invention.

FIG. 14 is a partial longitudinal section of an alternative embodiment of an ink jet printhead according to the invention. The various reference numerals in the Figure differ from the corresponding reference numerals in FIGS. 1–8 only in that they are here preceded by a "3".

The Embodiment shown here is essentially the same as that depicted in FIGS. 2 and 9, except with regard to the presence of a top plate. In contrast to the use of a separate top plate 237 in FIG. 9, the same purpose is served in FIG. 14 by an extra-thick top portion 337 of inactive actuator material 333 in the CMA actuator plate 325. The role of top plate in the present case is thus played by an integral block 337 of ceramic material rather than a separately mounted plate 237 of, for example, iron-nickel.

Embodiment 4

Figure 15:
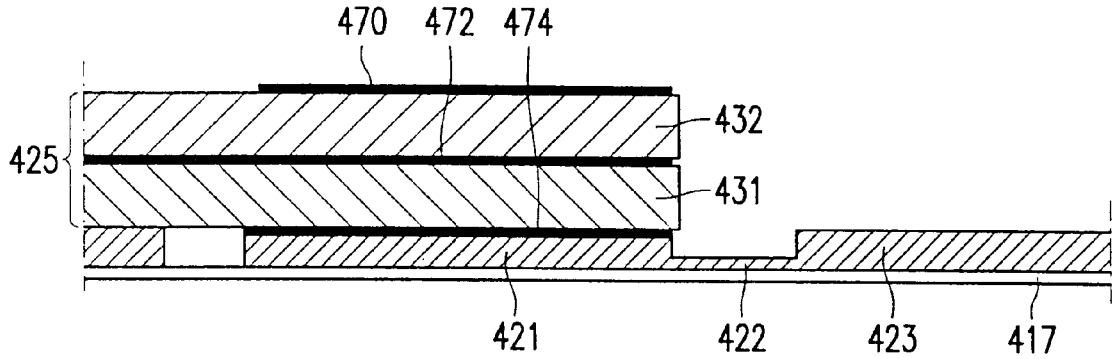
FIG. 15 is a partial longitudinal section of another embodiment of an ink jet printhead according to the invention.

FIG. 15 is a partial longitudinal section of another embodiment of an ink jet printhead according to the invention. The various reference numerals in the Figure differ from the corresponding reference numerals in FIGS. 1–8 only in that they are here preceded by a "4".

The actuator plate 425 in this case is not a CMA; instead, it consists of an active piezoelectric portion 431 and a non-active or oppositely polarized piezoelectric portion 432, in stacked arrangement, both portions 431,432 being relatively thick (e.g. of the order of 300 $\mu$m thick). A common electrode 472 is sandwiched between the portions 431 and 432, and a patterned (structured) electrode 470 is provided on top of the portion 432. The active piezoelectric portion 431 is soldered to the underlying piston 421 (via the solder joint 474), which is electrically connected to the associated electrical lead 423 via a relatively narrow electrical tract 422; because the tract 422 is narrow, vertical movement of the piston 421 with respect to the electrical lead 423 is minimally inhibited. As here depicted, the electrode 470 and solder joint 474 accurately overlap the piston 421; however, this is not strictly necessary.

Because the portion 432, which lies on top of the portion 431, is either non-active or oppositely polarized, there is no need for a separate top plate (such as plate 237 in FIG. 9).

Such an embodiment lends itself to high-voltage, low-current applications.

Embodiment 5

Figure 16:
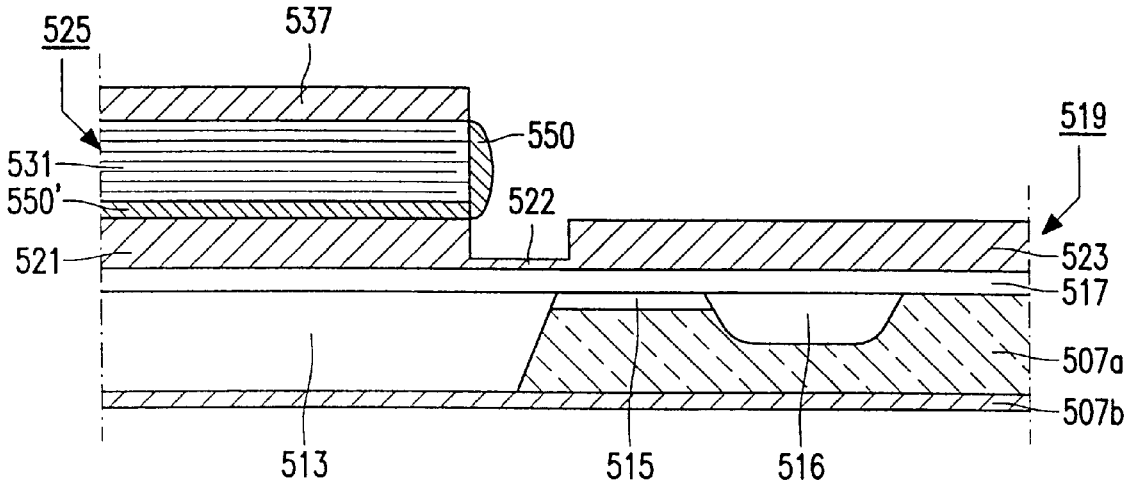
FIG. 16 is a partial longitudinal section of yet another embodiment of an ink jet printhead according to the invention.

FIG. 16 is a partial longitudinal section of yet another embodiment of an ink jet printhead according to the invention. The various reference numerals in the Figure differ from the corresponding reference numerals in FIGS. 1–8 only in that they are here preceded by a "5".

In this case, the actuator element 525 is a CMA 531 which is overlaid by a top plate 537. In contrast to the situation in FIGS. 9 and 14 (in which a wire bond 260 or 360 is employed), electrical contact with the actuator element 525 is achieved by using a metallic "blob" 550 (e.g. of solder or gold) to connect the exposed electrodes at the side of the CMA 531 to a base electrode 550' underlying the element 525. This base electrode 550' is in direct contact with the underlying piston 521. As in Embodiment 4 (FIG. 15), the piston 521 is electrically connected to the associated electrical lead 523 via a relatively narrow electrical tract 522.

Embodiment 6

Figure 17:
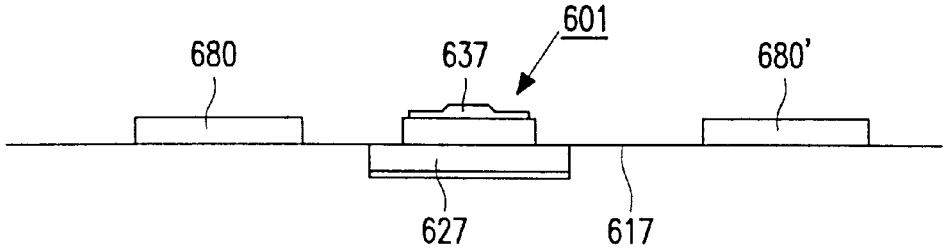
FIG. 17 depicts a modification to the concept presented in FIG. 8.
Figure 18:
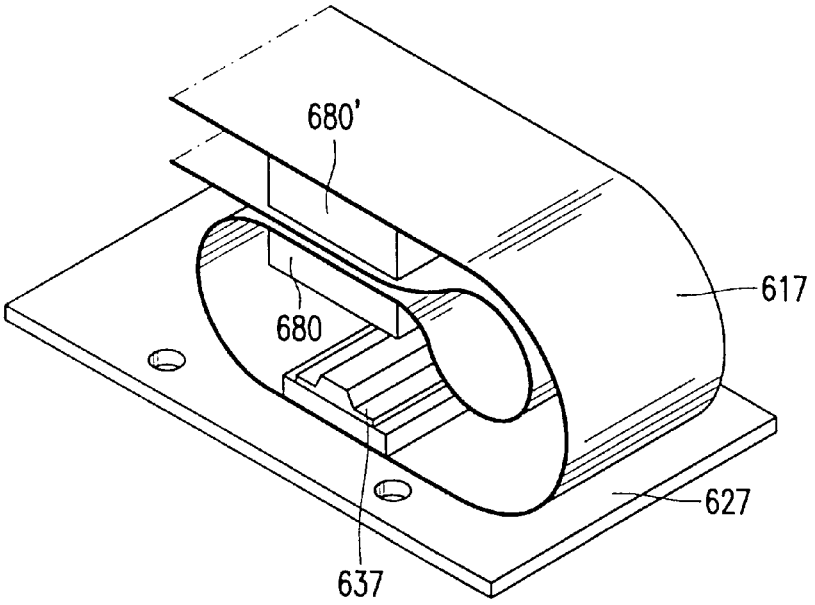
FIG. 18 shows the subject of FIG. 17 in a particular compact configuration.

FIGS. 17 and 18 depict a modification of the subject of FIG. 8. Corresponding features in the two Figures are denoted by the same reference numerals, which differ from the corresponding reference numerals in FIGS. 1–7 only in that they are here preceded by a "6".

In FIG. 8, the membrane 17 and electrical leads 19 depicted in FIG. 2 extend outside the periphery of the printhead 1 so as to form a flexfoil 117 carrying a plurality of conductor tracks 119. Because there is a great plurality of actuator elements 31 in FIG. 2, the number of conductor tracks 119 on the flexfoil 117 is correspondingly great.

FIG. 17 shows a measure which reduces the said number of conductor tracks. Here, a least one application-specific integrated circuit (ASIC) 680 is surface-mounted on the flexfoil 617 in relatively close proximity to the printhead 601 (in this particular case, there are two ASICs, 680,680'). The number of conductor tracks between the printhead 601 and the ASIC 680 is then of the same order of magnitude as in FIG. 8, but the number of conductor tracks between the ASIC 680 and the dangling (free) end of the flexfoil 617 is considerably reduced (e.g. only of the order of about 5). This is because the presence of the ASIC 680 allows matrix control of the printhead 601.

In FIG. 18, the flexfoil 617 has been coiled up in such a manner as to allow a compact arrangement of the ASICS 680,680' with respect to the printhead 601.

Embodiment 7

The nozzle plate 7*b* in FIG. 2 comprises, for example, a sheet of Ni—Fe alloy which is provided with an anti-wetting layer (e.g. Ni-TEFLON) on the surface remote from the overlying substrate plate 7*a*. The holes 14 in such a nozzle plate 7*b* can be made using a drill, for example.

Alternative materials from which the nozzle plate can be made include, for example:

glass;

ceramic;

plastic.

The holes in such a nozzle plate can then be created using, for example, a focused laser beam. In the case of a ceramic nozzle plate, the holes can also be created by structuring the ceramic material when it is still in the green phase. On the other hand, in the case of a plastic nozzle plate, the holes can be realized by incorporating suitable projective structures onto the inner wall of an injection-mould (using lithographic techniques, for example).

An anti-wetting layer (e.g. a silane) can be provided on the surface of the nozzle plate which will be remote from the overlying printhead structure (substrate plate). Such a layer can be deposited using a vapour deposition technique, for example.

What is claimed is:

1. An ink jet printhead comprising:

a body having first and second opposite main faces with a plurality of pressure chambers and a corresponding plurality of nozzles provided in the body, each pressure chamber extending between the first main face of the body and one of the nozzles and each nozzle extending between one of the pressure chambers and the second main face of the body;

a membrane having first and second main faces, said membrane being connected to the body with the second main face of the membrane facing the first main face of the body;

a substantially planar actuator plate having first and second main faces parallel to the actuator plate, the second main face of the actuator element facing the first main face of the membrane, said actuator plate comprising a plurality of actuator elements separated from each other by slits in the actuator plate and positioned directly over respective pressure chambers;

the actuator plate having active regions and inactive regions, the active regions forming the actuator body;

each actuator element being operative to change the actuator element dimension perpendicular to the first and second main faces of the actuator plate upon application of a suitable voltage to the actuator element; and a support plate positioned between the second main face of the actuator plate and the first main face of the membrane, the support plate comprising first portions and second portions with said first portions being movable relative to the second portions perpendicular to the support plate, one of the first portions being situated between each actuator element and a respective one of the pressure chambers.

2. An ink jet printhead as claimed in claim 1, wherein the actuator plate is a ceramic multilayer actuator.

3. An ink jet printhead as claimed in claim 1, further comprising a top plate attached to the first main face of the actuator plate, the top plate having slits corresponding to respective slits in the actuator plate.

4. An ink jet printhead as claimed in claim 3, wherein the top plate comprises first portions substantially extending over the active regions of the actuator plate and second portions substantially extending over the inactive regions of the actuator plate, the first portions of the top plate having a smaller thickness than the second portions.

5. An ink jet printhead as claimed in claim 1, wherein the actuator plate comprises a relatively thick inactive region adjacent to the first main face and overlying each active region extending over a first portion of the support plate.

6. An ink jet printhead as claimed in claim 1, wherein the actuator element comprises a plate of active piezoelectric material over which extends a plate of non-active material, the active plate being electrically connected to a first portion of the support plate, the active plate and non-active plate being sandwiched about an intervening common electrode, another electrode being provided on the surface of the non-active plate remote from the common electrode.

7. An ink jet printhead as claimed in claim 1, wherein the actuator element comprises a plate of active piezoelectric material over which extends a plate of oppositely polarized piezoelectric material, the active plate being electrically connected to a first portion of the support plate, the active plate and oppositely polarized plate being sandwiched about an intervening common electrode, another electrode being provided on the surface of the oppositely polarized plate remote from the common electrode.

8. An ink jet printhead as claimed in claim 1, wherein each active region of the actuator plate which extends over a first portion of the support plate is electrically connected to the adjacent second portion of the support plate using a wire bond.

9. An ink jet printhead as claimed in claim 1, wherein each active region of the actuator plate which extends over a first portion of the support plate is electrically connected to a base electrode which is situated between, and is in electrical contact with both of, the said first portion of the actuator plate and first portion of the support plate, and that the first portion of the support plate is electrically connected to the adjacent second portion of the support plate via a relatively narrow conductive tract.

10. An ink jet printer comprising a printhead, said printhead comprising:

a body having first and second opposite main faces, a plurality of pressure chambers and a corresponding plurality of nozzles being provided in the body, each pressure chamber extending between the first main face of the body and one of the nozzles and each nozzle extending between one of the pressure chambers and the second main face of the body;

a membrane having first and second main faces, said membrane being connected to the body with the second main face of the membrane facing the first main face of the body;

a substantially planar actuator plate having first and second main faces parallel to the actuator plate, the second main face of said actuator plate facing the first main face of the membrane, said actuator plate comprising a plurality of thin flat actuator elements between the first and second main faces of the actuator plate and corresponding to the plurality of pressure chambers, wherein the actuator elements are separated from each other by slits in the actuator plate and are positioned directly over respective pressure chambers in the body, the actuator plate having active regions and inactive regions, the active regions forming the actuator elements, each actuator element being operative to change the actuator element dimension perpendicular to the first and second main faces of the actuator plate upon application of a suitable voltage to the actuator element; and a support plate positioned between the second main face of the actuator plate and the first main face of the membrane and comprising first portions and second portions, wherein said first portions are located between respective ones of the actuator elements and respective corresponding pressure chambers and are movable relative to the second portions perpendicular to the support plate, one of said first portions being situated between each actuator element and a respective one of said pressure chambers.

11. An ink jet printhead as claimed in claim 2, further comprising a top plate attached to the first main face of the actuator plate and having slits corresponding to the slits in the actuator plate.

12. An ink jet printhead as claimed in claim 11, wherein the top plate comprises first portions substantially extending over the active regions of the actuator plate and second portions substantially extending over the inactive regions of the actuator plate, the first portions of the top plate having a smaller thickness than the second portions.

13. An ink jet printhead as claimed in claim 2, wherein the actuator plate comprises a relatively thick inactive region adjacent to the first main face and overlying each active region extending over a first portion of the support plate.

14. An ink jet printhead as claimed in claim 2, wherein the actuator element comprises a plate of active piezoelectric material forming an active plate over which extends a plate of non-active material, the active plate being electrically connected to a first portion of the support plate, the active plate and non-active plate being sandwiched about an intervening common electrode, another electrode being provided on the surface of the non-active plate remote from the common electrode.

15. An ink jet printhead as claimed in claim 2, wherein the actuator element comprises a plate of active piezoelectric material over which extends a plate of oppositely polarized piezoelectric material, the active plate being electrically connected to a first portion of the support plate, the active plate and oppositely polarized plate being sandwiched about an intervening common electrode, another electrode being provided on the surface of the oppositely polarized plate remote from the common electrode.

16. An ink jet printhead as claimed in claim 4, wherein each active region of the actuator plate which extends over a first portion of the support plate is electrically connected to the adjacent second portion of the support plate via a wire bond.

17. An ink jet printhead as claimed in claim 15, wherein each active region of the actuator plate which extends over a first portion of the support plate is electrically connected to the adjacent second portion of the support plate via a wire bond.

18. An ink jet printhead as claimed in claim 3, wherein each active region of the actuator plate which extends over a first portion of the support plate is electrically connected to a base electrode which is situated between, and is in electrical contact with both of, the said first portion of the actuator plate and first portion of the support plate, and that the first portion of the support plate is electrically connected to the adjacent second portion of the support plate via a relatively narrow conductive tract.

19. An ink jet printer as claimed in claim 10, further comprising a top plate is attached to the first main face of the actuator plate, the top plate having slits corresponding to the slits in the actuator plate.

20. An ink jet printer as claimed in claim 19, wherein the top plate comprises first portions substantially extending over the active regions of the actuator plate and second portions substantially extending over the inactive regions of the actuator plate, the first portions of the top plate having a smaller thickness than the second portions.

21. An ink jet printhead comprising:

a body having a plurality of pressure chambers and a corresponding plurality of nozzles, a membrane connected to the body and having first and second main faces with the second main face of the membrane contacting a first main face of the body, a substantially planar actuator plate having first and second main faces parallel to the actuator plate with the second main face facing the first main face of the membrane, said actuator plate comprising a plurality of actuator elements corresponding to the plurality of pressure chambers, the actuator plate having active regions and inactive regions with the actuator elements formed by the active regions of the actuator plate, adjacent actuator elements being separated from each other by slits in the actuator plate, wherein the actuator elements are positioned directly over respective pressure chambers, each actuator element being operative to change the actuator element dimension perpendicular to the actuator plate in response to an applied voltage, and a support plate positioned between the second main face of the actuator plate and the first main face of the membrane, the support plate comprising first portions and second portions with said first portions movable relative to the second portions perpendicular to the support plate, the first portions being situated between respective actuator elements and the corresponding pressure chambers.

22. The ink jet printhead as claimed in claim 21 wherein the membrane is sandwiched between the first main face of the body and the support plate and the support plate is sandwiched between a first main face of the membrane and the second main face of the actuator plate.

23. The ink jet printhead as claimed in claim 21 further comprising a top plate contacting the first main face of the actuator plate and and bearing against the actuated elements to restrain displacement upwards of said first main face of the actuator plate.

24. An ink jet printhead as in claim 1 wherein each actuator element is operative to increase its dimension perpendicular to the faces of the actuator plate upon application of a suitable voltage to the actuator element, whereby, upon application of a suitable voltage to one of said actuator elements, the element increases its dimension perpendicular to the faces and moves a respective one of said first portions toward a respective one of said pressure chambers.

25. An ink jet printhead as in claim 1 further comprising a top plate attached to the first main face of the actuator plate, the top plate bearing against the actuator elements to restrain displacement upwards of the first face of the actuator plate.

26. An ink jet printer as in claim 10 wherein each actuator element is operative to increase its dimension perpendicular to the faces of the actuator plate upon application of a suitable voltage to the actuator element, whereby, upon application of a suitable voltage to one of said actuator elements, the element increases its dimension perpendicular to the faces and moves a respective one of said first portions toward a respective one of said pressure chambers.

27. An ink jet printer as in claim 10 wherein a top plate attached to the first main face of the actuator plate, the top plate bearing against the actuator elements to restrain displacement upwards of the first face of the actuator plate.

* * * * *